US010538984B2

(12) United States Patent
Bell et al.

(10) Patent No.: US 10,538,984 B2
(45) Date of Patent: Jan. 21, 2020

(54) MINI-SEVERING AND BACK-OFF TOOL WITH PRESSURE BALANCED EXPLOSIVES

(71) Applicants: William T. Bell, Huntsville, TX (US); James G. Rairigh, Houston, TX (US)

(72) Inventors: William T. Bell, Huntsville, TX (US); James G. Rairigh, Houston, TX (US)

(73) Assignee: W.T. BELL INTERNATIONAL, INC., Houston, TX (US)

( * ) Notice: Subject to any disclaimer, the term of this patent is extended or adjusted under 35 U.S.C. 154(b) by 122 days.

(21) Appl. No.: 15/759,776

(22) PCT Filed: Sep. 18, 2015

(86) PCT No.: PCT/US2015/051033

§ 371 (c)(1),
(2) Date: Mar. 13, 2018

(87) PCT Pub. No.: WO2017/048290

PCT Pub. Date: Mar. 23, 2017

(65) Prior Publication Data

US 2019/0048676 A1 Feb. 14, 2019

(51) Int. Cl.
*E21B 29/02* (2006.01)
*E21B 17/06* (2006.01)

(52) U.S. Cl.
CPC ..... *E21B 29/02* (2013.01)

(58) Field of Classification Search
CPC ..... E21B 29/02; E21B 31/002; E21B 19/18; E21B 19/16; E21B 17/06; E21B 23/04
USPC ..... 166/377
See application file for complete search history.

(56) References Cited

U.S. PATENT DOCUMENTS

| | | | | |
|---|---|---|---|---|
| 4,298,063 | A * | 11/1981 | Regalbuto | E21B 29/02 102/308 |
| 4,352,397 | A | 10/1982 | Christopher | |
| 4,537,255 | A | 8/1985 | Regalbuto et al. | |
| 6,186,226 | B1 * | 2/2001 | Robertson | E21B 29/02 166/297 |
| 6,925,937 | B2 | 8/2005 | Robertson | |
| 7,104,326 | B2 | 9/2006 | Grattan et al. | |
| 7,530,397 | B2 | 5/2009 | Bell | |
| 8,297,365 | B2 * | 10/2012 | Dove | E21B 17/06 166/377 |
| 8,851,191 | B2 * | 10/2014 | Mhaskar | E21B 31/16 166/178 |
| 9,435,170 | B2 * | 9/2016 | Bell | E21B 33/124 |
| 9,879,494 | B2 * | 1/2018 | Bell | E21B 29/02 |

* cited by examiner

*Primary Examiner* — Kenneth L Thompson

(57) ABSTRACT

A "mini-severing and back-off" tool includes a tubular magazine for a column of explosive pellets that are sized in diameter to provide a predetermined weight of explosive per unit column length. The tubular wall is vented at prescribed intervals for fluid pressure equalization between the internal bore of the tubular and the fluid pressure around the outside of the tubular. A fluid barrier is positioned between one end of the explosive pellet tubular and a detonator or an explosive booster provided to detonate the explosive pellet tubular. The explosive pellet tubular is positioned within the flow bore of a pipe string and adjacent to an intended pipe joint, and the explosive pellet tubular is detonated simultaneously with an application of torque on the pipe string, wherein the torque is applied in the thread release direction to disassemble the intended pipe joint.

28 Claims, 3 Drawing Sheets

MINI-SEVERING AND BACK-OFF TOOL WITH PRESSURE BALANCED EXPLOSIVES

CROSS-REFERENCE TO RELATED APPLICATION

The present application is a domestic application that claims priority to, and the benefit of, International Patent Cooperation Treaty (PCT) Application No. PCT/US2015/051033, filed on Sep. 18, 2015, and having a title of "Mini-Severing And Back-Off Tool With Pressure Balanced Explosives," which is incorporated herein in its entirety.

FIELD

The present invention relates generally to equipment and processes for deep well drilling. More particularly, the invention is directed to methods and/or apparatuses comprising pressure balanced explosives and usable for decoupling or unthreading a specific drill pipe collar or casing joint from a downhole string of pipe.

BACKGROUND

Rotary drilling of deep wells for the production of fluid minerals, such as oil and gas, relies upon long assemblies of multiple pipe sections called "strings". Each pipe unit or section of pipe for this purpose, normally, is in the order of nine to twelve meters (30 to 40 feet) in length and threaded at each end for the making up of the strings.

Drill pipe, which forms the primary pipe string for advancing the borehole depth and often provides rotational torque to the drill bit, is usually fabricated with tapered external threads at one end and tapered internal threads at the opposite end. The external threads of a segment or section of drill pipe are formed into a heavy tool joint called a "pin," which can be welded to one end of the drill pipe section. The internal threads of the section of the drill pipe are formed into a complementary tool joint called a "box," which can be welded to the opposite end of the drill pipe section. Notably, drill pipe tool joints have a significantly greater outside diameter than the remaining length of the pipe section.

Drill collars are a special case of thick-walled drill pipe in which the entire length of the thick-walled pipe section has approximately the same outer diameter (O.D.) as the tool joint of the corresponding pipe to provide maximum weight to a pipe section. In theory, drill collars are the operational bearing weight applied to the drill bit. The number of drill collars in a drill string can determine the value of the bearing force applied to the drill bit. The drill string above the drill collars is, theoretically, suspended in tension. Hence, the drill collars are located at the bottom end of a drill string, just above the drill bit.

Oil field casing and tubing pipe are usually formed with external threads at both ends of a pipe section. Two sections of pipe are joined together by a short length "close coupling" having internal threads at opposite ends.

In the course of downhole operations, such pipe strings occasionally become tightly stuck in a well. Typically, the borehole walls of loose or unstable geological strata, which is penetrated by the pipe string, "sluff" or collapse into the borehole around the pipe string and above the drill bit, thus forming a formation seizure. Such a wall collapse may occur for hundreds or even thousands of feet along the borehole length. In such an event, it is impossible to withdraw the pipe string from the borehole or, in most cases, even rotate the pipe string.

Often, it is desirable to retrieve as much of the pipe string above the seizure point as possible. In any case, it is essential to extract the drill string above the seizure point to enable further operations. However, simply reversing the rotation of the pipe string will not necessarily separate the string at the first screwed joint above the seizure. As additional pipe sections are added to a pipe string, the earlier assembled joints become tighter and more difficult to unthread or decouple. Consequently, without some focused intervention, an upper threaded joint will normally disassemble before a lower threaded joint.

Accordingly, drill collars, being at the bottom end of the string, frequently are the most tightly joined. Moreover, it is along the drill collar portion of the drill string that a formation seizure is most likely to occur. Furthermore, due to the massive quantity of alloyed steel present in a drill collar, the drill collars are among the most valuable components of a drill string, thereby adding to the incentive to recover as many of the drill collars as possible.

There are numerous methods and devices for locating the seizure point along a pipe string. A representative existing method and apparatus, disclosed in U.S. Pat. No. 7,383,876, are usable for identifying a specific joint above a seizure point and are incorporated herein by reference. After locating the specific joint above the seizure point, the traditional method, which is used to effect release of the threaded assembly at the specific joint, is to apply a gentle or moderate "left hand" torque to the top or surface end of the pipe string, as the specific joint is jarred by a nearby explosion. However, as discussed below, these traditional methods encounter serious functional and reliability issues when used at great depths, particularly where the environmental conditions include high temperatures and/or high pressures.

Explosive devices for urging the release of screwed joints have heretofore been made in various forms. Typically, a "back-off tool", as such devices are characterized in the well drilling arts, comprises detonation cord, such as "Primacord", which is a flexible tube filled with a suitable high explosive, such as HMX, RDX or HNS, that is set off by an electrically initiated detonator. When used under low temperature and pressure conditions prevailing in shallow wells, prior art "back-off" tools and methods have produced generally satisfactory results. However, in extremely deep wells of 6,000 meters (20,000 ft.) or greater, where the temperatures may be in the order of 200° C. (400° F.) or greater and the pressures may be several thousand pounds per square inch, the prior art methods and apparatus encounter serious functional and reliability issues. For example, high pressures tend to decrease the explosive detonation sensitivity and suppress the shock intensity of an explosion, thus causing a complete lack of function or a diminished function of the explosives taught by the prior art methods and apparatus. In addition, high temperatures tend to reduce the energy of the explosive, thus causing a lack of function or a diminished function with regard to the prior art methods and apparatus.

Determining the exact quantity of explosive to detonate against a particular pipe joint, at a particular depth, and in a particular well, remains, to a large degree, a skilled art form. Prior experimentation and testing has led to the development of tabulations of recommended explosive distribution rates for a range of frequently encountered circumstances. Such tabulations of empirically developed data are generally stated in terms of explosive weight values per unit length (e.g., grains of explosive distributed over a foot of length). For example, joints of drill collar sizes that are greater than 19.05 cm (7½ inch), positioned at depths below 2,300 m (7,500 ft.), may require an explosive distribution rate in excess of 300 grams per meter (1400 grains per foot) of length for the uncoupling of the drill collars. However, detonation cord is largely limited to distribution rates of 21 grams per meter (100 grains per foot) of explosive length. Therefore, while the distributed weight value of detonation cord may be increased by detonating multiple parallel cords simultaneously, this technique is largely limited to about a maximum of fourteen (14) detonation cords. Therefore, using 21 grams per meter (100 grains per foot) cords, the use of fourteen (14) cords will allow only 300 grams of explosive per meter (1400 grains per foot) of length. Hence, for releasing 19.05 cm (7½ inch) drill collar joints at greater than 2,300 meters (7,500 ft.) of depth, methods other than multiple detonation cords are required and are necessary to position a sufficient distribution of explosive weight adjacent to the targeted drill collar joint. As such, existing methods and apparatus cannot perform successfully at such great depths.

A need exists for methods and apparatus that are usable for decoupling or unthreading an intended drill collar or pipe joint (i.e., threaded tool joint) from a downhole string of pipe in high temperature conditions, high pressure conditions, and/or at great depths.

A further need exists for determining and providing the exact quantity of explosive needed for detonation against an intended drill collar or pipe joint, at a particular depth and in a particular well, to decouple or unthread the intended drill collar or pipe joint.

The embodiments of the present invention meets all of these needs.

SUMMARY OF THE INVENTION

The "mini-severing and back-off" tool of the present invention comprises a firing head, an initiation body, and an explosive pellet tube. Operationally, the back-off tool is usually suspended at, for example, the distal end of a wireline or tubing string for downhole positioning and detonation control, while the drilling rig rotary table simultaneously imposes a moderate degree of torque on the intended threaded drill collar or pipe joint in the "left-hand" or "unscrew" direction, for disassembly of the intended drill collar or pipe joint.

The firing head houses and comprises a detonator (e.g., an electrically initiated detonator) that can be secured within an axial cavity. The detonator comprises a small quantity of explosive enclosed within an axial projection.

The initiation body (i.e., initiation housing) can assemble with the firing head and can house at least one pellet of explosive that can be positioned in detonation proximity with a booster explosive 40 and a booster cavity 41, which is housed also within the initiation housing and which is in ignition proximity to the detonator (i.e., projection of the detonator). Below the booster cavity, and opposite from the detonator, is a threaded socket for receipt of a pellet tube (i.e., explosive pellet tube when loaded with at least one pellet of explosive). The threaded socket can penetrate the initiation housing to position the explosive pellet tube and/or the at least one pellet of explosive within detonation proximity of the booster explosive 40 and booster cavity 41, which is in ignition proximity with the detonator (i.e., detonator projection); but in doing so, the threaded socket does not penetrate the booster cavity.

The explosive pellet tube can comprise a small diameter tube, e.g., 1.25 to 2.5 cm (0.5 inch to 1 inch), having, for example, about 2.4 m to 3.1 m (8 ft. to 10 ft.) of length, and the explosive pellet tube can be secured to the center of the initiator body by, for example, welding or by use of the threaded socket at its upper distal end. The distal end of the explosive pellet tube can be closed by a detachable nose piece. The explosive pellet tube wall can be vented by an aperture, which can be formed at approximately 0.6 m (2 ft.) intervals along its length; and therefore, the explosive pellet tube can be pressure differentially balanced against downhole well pressure across a thin tube wall. A plurality of small diameter pellets, which can be made up of compacted explosive material, such as HMX, can be aligned and loaded along the internal bore of the explosive pellet tube. A coil spring can be positioned in the bore of the explosive pellet tube, between the lowermost explosive pellet and the nose piece, to resiliently bias the column of explosive pellets toward the upper end of the explosive pellet tube, within detonation proximity of the booster explosive (i.e., booster pellet). The explosive distribution rate can be determined by the explosive pellet diameter.

An embodiment of the present invention includes a downhole mini-severing and back-off tool that comprises a firing head that can be secured to an initiation housing. The firing head comprises a detonator, which can be positioned in ignition proximity to a booster explosive positioned within the initiation housing. The embodiment of the downhole mini-severing and back-off tool can further comprise a pellet tube that can be secured (e.g., threadably connected) in the initiation housing, and the pellet tube can comprise a plurality of explosive pellets that can be arranged in contiguous alignment within an enclosure wall of the pellet tube. Embodiments of the mini-severing and back-off tool can include a bias at a first end of the plurality of explosive pellets, wherein the bias can urge a second end of the plurality of explosive pellets into detonation proximity with the booster explosive. In an embodiment, the bias positioned at the first end of the plurality of explosive pellets can be mechanical, such as a coil spring.

The mini-severing and back-off tool can further comprise at least one aperture formed in the enclosure wall of the pellet tube, wherein the at least one aperture can substantially equalize a pressure within the enclosure wall of the pellet tube with a pressure external of the enclosure wall of the pellet tube. In an embodiment, the at least one aperture can comprise a plurality of apertures that can be distributed in intervals along a length of the enclosure wall. For example, the plurality of apertures can be distributed at approximately 0.6 m (2 ft.) intervals.

In an embodiment, the mini-severing and back-off tool can further comprise a fluid barrier disposed between the booster explosive and the plurality of explosive pellets. In an embodiment of the back-off tool, O-rings or other sealing members can be used for sealing between the detonator and the initiation housing to prevent potential contamination from well fluid and other sources.

Another embodiment of the present invention includes a method of releasing a threaded pipe joint within a pipe string, which comprises the steps of providing a tube having a bore space enclosed by a tube wall, providing an initiation housing, placing a booster explosive within the initiation housing, and securing a first end of the tube to the initiation housing. The steps of the method can continue by penetrating the tube wall with at least one aperture to equalize pressure internal and external to the tube wall, inserting a plurality of explosive pellets into the bore space, and biasing against one end of the plurality of explosive pellets to urge an opposite end of the plurality of explosive pellets into detonation proximity with the booster explosive. The steps of the method can conclude with positioning the tube within a pipe string flow bore adjacent to a threaded pipe joint, applying a moderate torque on the pipe string, and detonating at least one of the plurality of explosive pellets for disassembling the pipe string.

In an embodiment, the step of penetrating the tube wall with at least one aperture can comprise penetrating the tube wall with a plurality of apertures at regular intervals, which can include, for example, approximately 0.6 m (2 ft.) intervals.

In an embodiment, the step of biasing against one end of the plurality of explosive pellets can be accomplished with a mechanical device, for example, a coil spring.

In an embodiment, the method of releasing a threaded pipe joint within a pipe string can include the step of providing a fluid barrier between the booster explosive and the plurality of explosive pellets to prevent contamination of the booster explosive.

In an embodiment of the method, the step of inserting a plurality of explosive pellets into the bore space can comprise contiguously aligning and inserting each of the plurality of explosive pellets into the bore space.

Another embodiment of the present invention includes a method usable for releasing an intended pipe joint threaded within a pipe string, which comprises the step of tabulating values representing a weight of explosive distributed over a unit length corresponding to a type of pipe, a size of pipe, a well depth location of the intended pipe joint, a density of fluid within a well, or combinations thereof, such that when the explosive is detonated adjacent to the intended pipe joint, and under moderate torque, the detonation will initiate the release of the intended pipe joint. The method can further comprise the steps of contiguously aligning a plurality of explosive pellets, which have a concentration of explosive corresponding to the tabulated value adjacent to the intended pipe joint within a tubular bore, and venting a wall of the tubular bore with at least one aperture to equalize pressure within the tubular bore to pressure external to the tubular bore. The method can conclude with the steps of positioning the tubular bore within the pipe string and proximate to the intended pipe joint, applying a moderate torque to the pipe string, and detonating the plurality of explosive pellets, simultaneously, with the application of the moderate torque to disassemble the pipe string.

In an embodiment of the method, the step of venting a wall of the tubular bore with at least one aperture can include venting the wall with a plurality of apertures at regular intervals, which can include, for example, approximately 0.6 m (2 ft.) intervals.

In an embodiment of the method, the step of detonating the plurality of explosive pellets can be accomplished by a booster explosive positioned at one end of, and in detonation proximity with, the plurality of explosive pellets.

In an embodiment, the method can further comprise the step of providing a fluid barrier between the booster explosive and the plurality of explosive pellets to prevent contamination from potential well fluids or other sources.

Another embodiment of the present invention includes a downhole back-off tool that comprises a firing head and a pellet tube secured to an initiation housing. In this embodiment, the firing head comprises a detonator, and the pellet tube comprises an enclosure wall, wherein a plurality of explosive pellets can be included in a contiguous alignment within the enclosure wall of the pellet tube. The embodiment of the back-off tool can further comprise at least one of the plurality of explosive pellets (e.g., an uppermost explosive pellet) positioned within ignition proximity of the detonator, and a bias can be positioned at a first end of the plurality of explosive pellets, wherein the bias can be used to urge a second end of the plurality of explosive pellets in detonation proximity with the booster explosive. The bias, which is positioned at the first end of the plurality of explosive pellets, can be a mechanical device, such as a coil spring.

In an embodiment, at least one aperture can be formed in the enclosure wall of the pellet tube, wherein the at least one aperture can substantially equalize a pressure within the enclosure wall of the pellet tube with a pressure external of the enclosure wall of the pellet tube. In an embodiment, the at least one aperture can comprise a plurality of apertures that can be distributed along a length of the enclosure wall at various or regular intervals, which can include for example, approximately 0.6 m (2 ft.) intervals.

In an embodiment, the back-off tool can further comprise a fluid barrier disposed between the detonator and at least one of the plurality of explosive pellets. In an embodiment, O-rings or other elastomeric sealing members can be used to seal between the firing head and the initiation housing to prevent contamination of the booster explosive from potential well fluids or other contaminating sources.

Another embodiment of the present invention includes a method of releasing a threaded pipe joint within a pipe string, which includes the steps of providing a tube having a bore space enclosed by a tube wall, providing an initiation housing, securing a first end of the tube to the initiation housing, providing a firing head having an explosive detonator therein, and securing the initiation housing to the firing head. The steps of the method can continue by penetrating the tube wall with at least one aperture to equalize pressure internal and external to the tube wall, inserting a plurality of explosive pellets into the bore space, and biasing against one end of the plurality of explosive pellets to urge an opposite end of the plurality of explosive pellets into detonation proximity with said detonator. The method can conclude with the steps of positioning the tube within a pipe string flow bore adjacent to a threaded pipe joint, applying a moderate torque on the pipe string, and simultaneously detonating at least one of the plurality of explosive pellets for disassembling the pipe string.

In an embodiment, the step of penetrating the tube wall with at least one aperture can comprise penetrating the tube wall with a plurality of apertures at intervals, which can include, for example, approximately 0.6 m (2 ft.) intervals.

In an embodiment, the step of biasing against one end of the plurality of explosive pellets can be accomplished with a mechanical device, such as a coil spring.

In an embodiment, the method of releasing a threaded pipe joint within a pipe string, can further comprise the step of providing a fluid barrier between the explosive detonator and the plurality of explosive pellets. In an embodiment, the step of inserting a plurality of explosive pellets into the bore space can comprise contiguously aligning and inserting each of the plurality of explosive pellets into the bore space.

BRIEF DESCRIPTION OF THE DRAWINGS

Relative to the drawings wherein like reference characters designate like or similar elements or steps through the several figures of the drawings.

DETAILED DESCRIPTION OF THE INVENTION

Before explaining selected embodiments of the present invention in detail, it is to be understood that the present invention is not limited to the particular embodiments described herein and that the present invention can be practiced or carried out in various ways. As used herein, the terms "up" and "down", "upper" and "lower", "upwardly" and downwardly", "upstream" and "downstream"; "above" and "below"; and other like terms, indicating relative positions above or below a given point or element, are used in this description to more clearly describe some embodiments of the invention. However, when applied to equipment and methods for use in wells that are deviated or horizontal, such terms may refer to a left to right, right to left, or other relationship as appropriate. Moreover, in the specification and appended claims, the terms "pipe", "tube", "tubular", "casing", "liner" and/or "other tubular goods" are to be interpreted and defined generically to mean any and all of such elements without limitation of industry usage.

Figure 1:
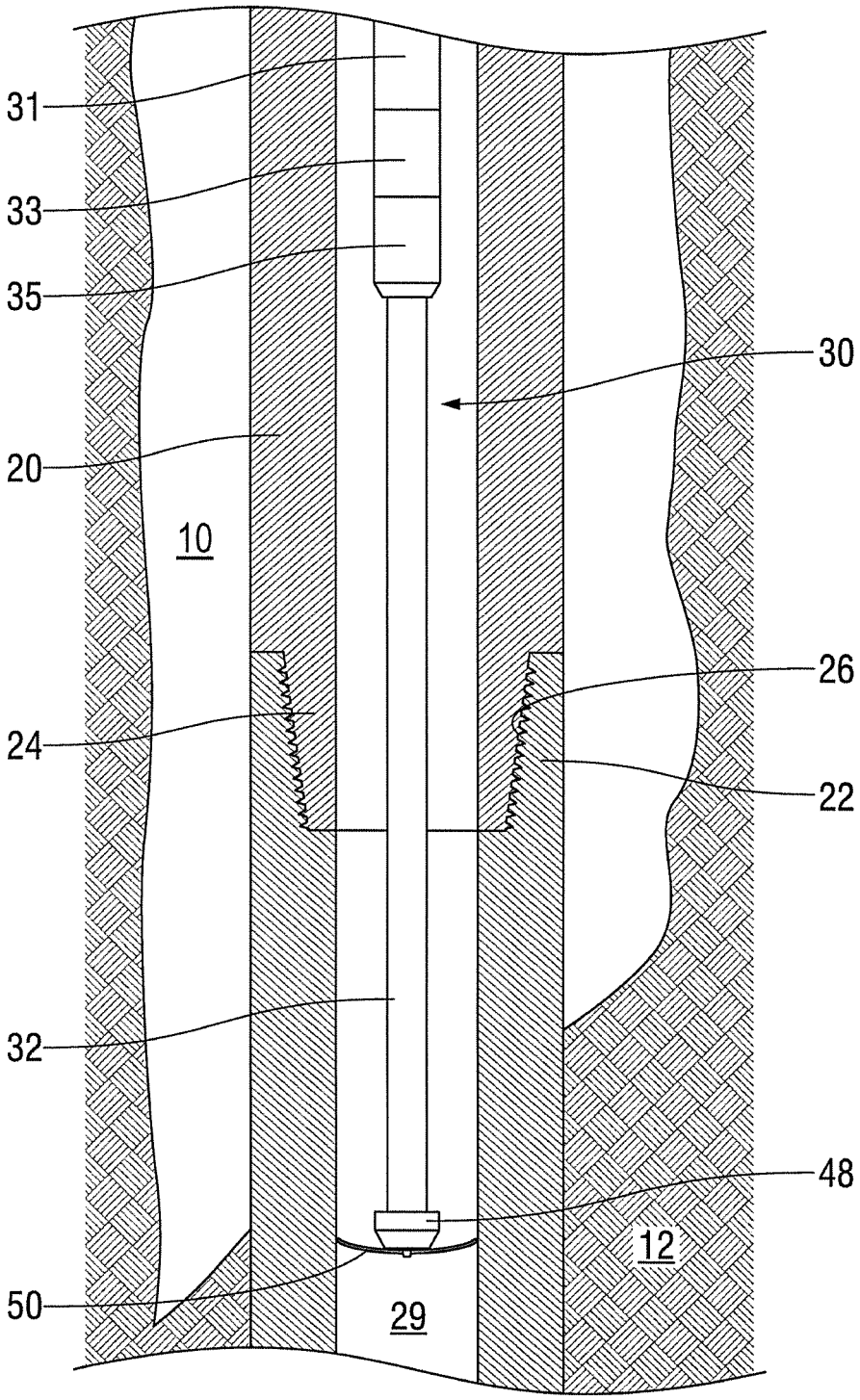
FIG. 1 represents a section of raw borehole having a drill string seized therein by a collapsed borehole wall.

To illustrate the operational environment of the invention, reference is given to the sectional view of FIG. 1 showing a drill collar portion of a drill pipe string 20 suspended in a raw borehole 10. Below the box joint 22, the drill pipe string 20 is immovably seized by a borehole wall collapse (i.e., seizure point) 12. Following the drill pipe seizure, an immediate operational objective, of the well drilling management, normally is to locate the seizure point 12 and to de-couple the threaded tool joint assembly 26, between the first box 22 and pin 24 assembly, above the seizure point 12.

Figure 2:
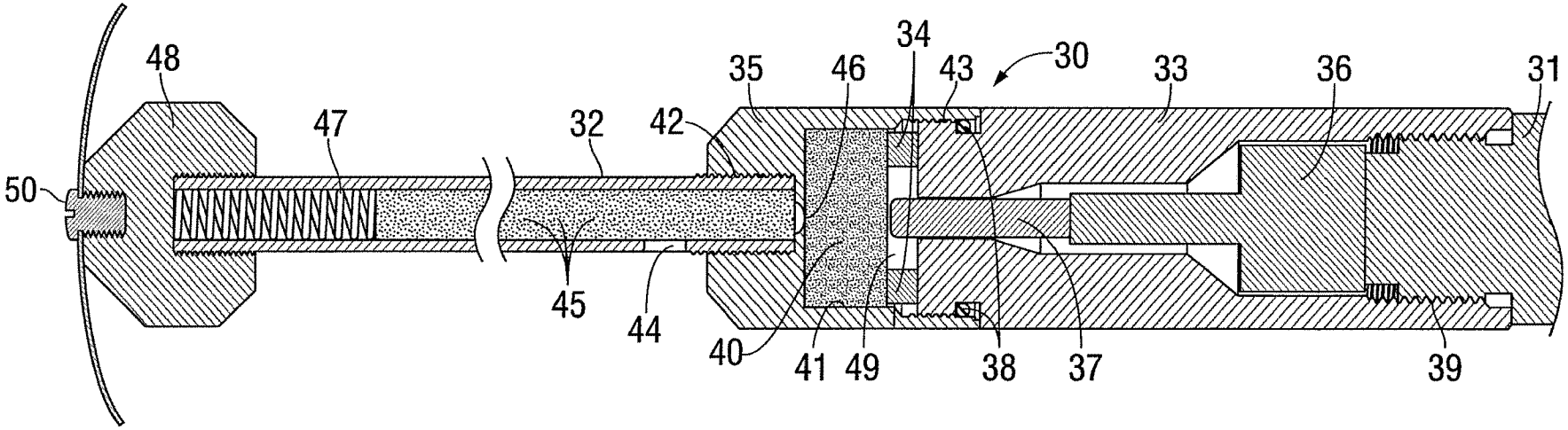
FIG. 2 is an embodiment of an enlarged detail of a firing head and pellet tube assembly.

After having located a threaded tool joint assembly 26 that is above the seizure point 12, preferably the first threaded joint above the seizure, the present mini-severing and back-off tool 30 is suspended within the drill collar flow bore 29 by an appropriate suspension string, such as a wire line, slick line or, as illustrated, from a length of coiled tubing 31. As shown in FIG. 1, the mini-severing and back-off tool 30 comprises an initiation housing 35 and a firing head 33. A suitable connection mechanism, such as a bail or threads 39, as shown in FIG. 2, can be used to secure the back-off tool 30 to the end of a coiled tubing string 31, for example. The back-off tool 30 can be positioned to locate the explosive pellet tube 32 in bridging opposition of the specifically identified threaded tool joint assembly 26. As shown in FIG. 1, the explosive pellet tube 32 can include at least one centralizer 50 fastened to the distal end of the nose piece 48 of the mini-severing and back-off tool 30.

Referring to FIG. 2, the firing head 33 houses an electrical ignition circuit 36, which can be used for igniting an electrically initiated detonator 37. The detonator 37 can project from the end of the firing head into an ignition proximity with a pellet of booster explosive 40 (i.e., booster explosive) that can be encapsulated within a booster cavity 41 of the initiation housing 35. "Ignition proximity" is a spatial separation between a donor or detonator explosive and a receptor explosive, and within which area or vicinity the ignition of the detonator will result in the detonation of the receptor explosive. An "O-ring" seal 38 is positioned between the firing head 33 and the initiation housing 35 for isolating the booster explosive 40, located in the booster cavity 41, from potential well fluid contamination. Additionally, the firing head 33 and the initiation housing 35 can be threadably connected 43 and can be set off by at least one washer 34 which, in an embodiment, can be constructed of a flexible polymer material, such as silicone. This offset creates an empty chamber 49 between the two materials which allows the ignition reaction, between the booster explosive 40 and the detonator 37, to take place at atmospheric pressure.

The lower end of the initiation housing 35 can include a threaded socket 42 for securing a pellet tube 32, for example, a 3.1 m (10 ft.) long pellet tube 32. The lower distal end of the pellet tube 32 can be terminated by a nose piece 48. Explosive pellets 45 can fill the length of the pellet tube 32 in contiguous serial alignment to form the explosive pellet tube 32. The first of such explosive pellets 45 in the contiguous serial alignment should be positioned within detonation proximity of the booster explosive 40. A mechanical bias 47, such as coil spring, can be compressed between the nose piece 48 and the lowermost explosive pellet 45.

Along the length of the explosive pellet tube 32, at approximately 2 ft. intervals, for example, vent apertures 44 can be formed through the wall of the explosive pellet tube 32. The vent apertures 44 allow the fluid pressure within the bore of the explosive pellet tube 32 to equalize with the fluid pressure outside the explosive pellet tube 32. Although it is conventional prior art wisdom to isolate explosive materials from direct contact with well fluids, it has been found that such concerns are greatly overstated. Due to the brief time periods of exposure, usually less than 1 hour, and the high degree of explosive compaction, it has been discovered that back-off tool explosives are largely unaffected by well fluid exposure. Consequently, the explosive pellet tube 32 may be constructed, for example, of thin wall, mild steel. At the upper end of the explosive pellet tube 32, between the booster cavity 41 and an uppermost explosive pellet of the plurality of explosive pellets 45, a fluid barrier 46 can be formed within the initiation housing 35 structure to isolate the booster explosive 40 from any well fluid contamination arriving from the bore of the pellet tube 32.

In conducting the selection process for the size of the explosive pellet tube 32 and the consequent explosive weight distribution, a few parameters can be determined and considered, including the nominal size of the pipe joint to be un-screwed, the well depth of the seizure, and the fluid density of the in situ well fluid. From these determined parameters, an explosive weight distribution value per unit of length can be suggested for shocking a pipe (i.e., tubing) coupling. Notably, the suggested explosive weight distribution value can be a distributed explosive value in grains per foot. When the explosive pellets 45 within the pellet tube 32 detonate, the resulting shock is a relatively low grade expansion within the tubing bore, along the length of pellet tube 32 and across the intended coupled or threaded pipe joint assembly 26 (See FIG. 1). In addition, the explosive pellet tube 32 can include at least one centralizer 50, embodied in FIG. 2 as two blades of sheet metal fastened to the distal end of the nose piece 48. Alternatively, embodiments of the present invention may utilize any centralizer, usable for centralizing a downhole tool, or no centralizer.

"Moderate" torque, as applied herein, is a highly subjective value determined in each case by the driller. Although most, if not all, modern drilling rigs have reasonably precise torque measuring capacity, which can be highly variable; however, the torque measuring capacity can also be very specific to a particular type of pipe, e.g. casing, drill pipe or tubing, and can be sufficient to unscrew a particular tool joint under back-off shock, but not unscrew any other tool joint in the string. Hence, the value of "moderate" torque is a subjective operational value that is recognized by those of skill in the art for the particular equipment with which they are working.

Figure 3:
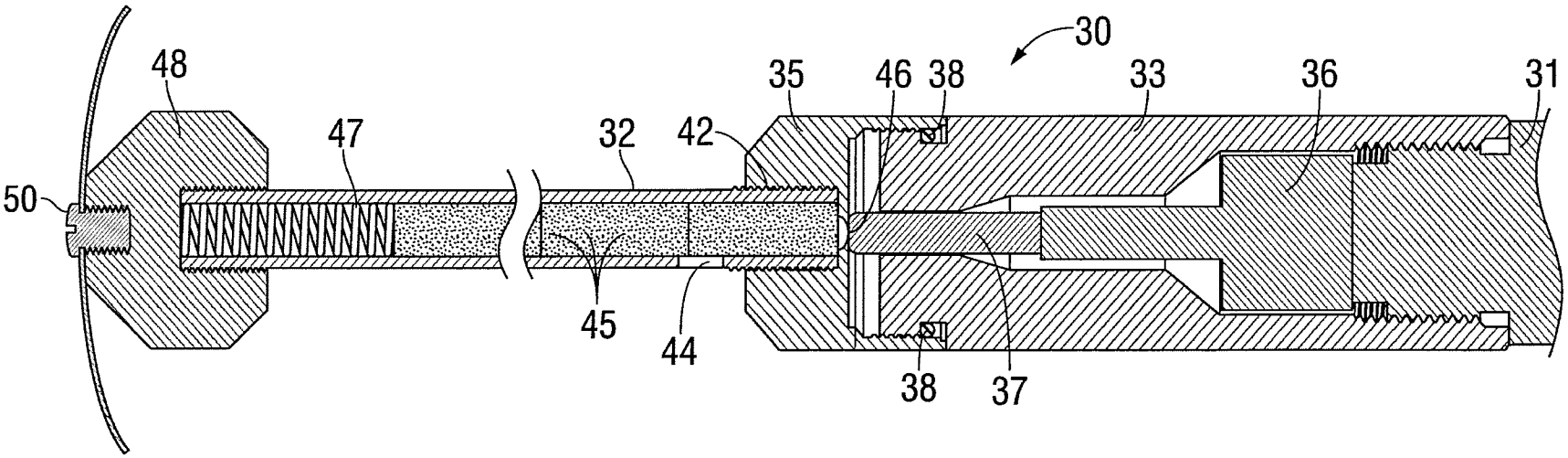
FIG. 3 is an alternate embodiment of a firing head and pellet tube assembly.

An alternative embodiment of the mini-severing and back-off tool is shown in FIG. 3 which omits the explosive booster 40 and positions the detonator 37 in ignition proximity of an uppermost explosive pellet of the plurality of explosive pellets 45. As shown, the firing head 33 can be threadably connected, at a first end, to a suspension string, such as a wire line, slick line or, as illustrated, from a length of coiled tubing 31, for lowering the mini-severing and back-off tool 30 into a bore, for example, a drill collar flow bore 29 (shown in FIG. 1). At the second or opposite end, the firing head 33 can be threadably connected to an initiation housing 35, wherein O-ring seals or other sealing members can be positioned, between the initiation housing 35 and firing head 33, to prevent contamination from well fluids and other potential contaminating sources.

The firing head 33 can house an electrical ignition circuit 36, which can be used for igniting an electrically initiated detonator 37, which can project through the firing head 33 and into ignition proximity with an uppermost explosive pellet 45 that is aligned within an explosive pellet tube 32 (i.e., pellet tube 32 comprising explosive pellets 45). At the upper end of the explosive pellet tube 32, between the detonator 37 and the uppermost explosive pellet 45, a fluid barrier 46 can be formed within the initiation housing 35 structure to isolate the detonator 37 from any well fluid contamination arriving from the bore of the pellet tube 32.

Along the length of the explosive pellet tube 32 and at regular intervals, for example, at approximately 0.6 m (2 ft.) intervals, one or more vent apertures 44 can be formed through the wall of the explosive pellet tube 32. The vent apertures 44 allow the fluid pressure within the bore of the explosive pellet tube 32 to equalize with the fluid pressure outside the explosive pellet tube 32.

As shown in FIG. 3, the lower end of the initiation housing 35 can include a threaded socket 42 for securing the pellet tube 32. Explosive pellets 45 can fill the length of the pellet tube 32 in contiguous serial alignment to form the explosive pellet tube 32, with the first or uppermost of such explosive pellets 45, in the contiguous serial alignment, positioned within detonation proximity of the detonator 37. A mechanical bias 47, such as coil spring, can be compressed between a nose piece 48, located at a distal end of the pellet tube 32, and the lowermost explosive pellet 45. In an embodiment, the explosive pellet tube 32 can include at least one centralizer 50, embodied in FIG. 3 as two blades of sheet metal fastened to the distal end of the nose piece 48. Alternatively, embodiments of the present invention may utilize any centralizer, usable for centralizing a downhole tool, or no centralizer.

Although the invention disclosed herein has been described in terms of specified and presently preferred embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention.

The invention claimed is:

1. A downhole mini-severing and back-off tool apparatus comprising:

a firing head secured to an initiation housing, wherein the firing head comprises a detonator therein positioned in ignition proximity to a booster explosive within the initiation housing;

a pellet tube secured in the initiation housing, wherein the pellet tube comprises an enclosure wall;

a plurality of explosive pellets in contiguous alignment within the enclosure wall of the pellet tube;

a bias at a first end of the plurality of explosive pellets, wherein the bias urges a second end of the plurality of explosive pellets in detonation proximity with the booster explosive; and at least one aperture in the enclosure wall of the pellet tube, wherein the at least one aperture substantially equalizes a pressure within the enclosure wall of the pellet tube with a pressure external of the enclosure wall of the pellet tube prior to detonation.

2. The apparatus as described by claim 1, wherein the bias at the first end of the plurality of explosive pellets is mechanical.

3. The apparatus as described by claim 2, wherein the mechanical bias at the first end of the plurality of explosive pellets comprises a coil spring.

4. The apparatus as described by claim 1, wherein the at least one aperture comprises a plurality of apertures distributed along a length of the enclosure wall.

5. The apparatus as described by claim 4, wherein the plurality of apertures are distributed at approximately two-foot intervals.

6. The apparatus as described by claim 1, further comprising a fluid barrier disposed between the booster explosive and the plurality of explosive pellets.

7. The back-off tool as described by claim 1, further comprising an O-ring seal between the firing head and the initiation housing.

8. A method of releasing a threaded pipe joint within a pipe string comprising the steps of:

providing a tube having a bore space enclosed by a tube wall;

providing an initiation housing;

placing a booster explosive within said initiation housing;

securing a first end of said tube to said initiation housing;

penetrating said tube wall with at least one aperture to equalize pressure internal and external to the tube wall;

inserting a plurality of explosive pellets into the bore space;

biasing against one end of the plurality of explosive pellets to urge an opposite end of the plurality of explosive pellets into detonation proximity with the booster explosive;

positioning the tube within a pipe string flow bore adjacent to a threaded pipe joint;

applying a torque on the pipe string for disassembling the pipe string; and detonating at least one of the plurality of explosive pellets.

9. The method of claim 8, wherein the step of penetrating said tube wall with at least one aperture comprises penetrating said tube wall with a plurality of apertures at approximately two-foot intervals.

10. The method of claim 8, wherein the step of biasing against one end of the plurality of explosive pellets is accomplished with a coil spring.

11. The method of claim 8, further comprising the step of providing a fluid bather between the booster explosive and the plurality of explosive pellets.

12. The method of claim 8, wherein the step of inserting a plurality of explosive pellets into the bore space comprises contiguously aligning and inserting each of the plurality of explosive pellets into the bore space.

13. A method of releasing an intended pipe joint threaded within a pipe string, wherein said method comprises the steps of:

tabulating values representing a weight of explosive distributed over a unit length corresponding to a type of pipe, a size of pipe, a well depth location of the intended pipe joint, a density of fluid within a well, or combinations thereof, such that when the explosive is detonated adjacent to the intended pipe joint and under moderate torque, the detonation will initiate the release of the intended pipe joint;

contiguously aligning a plurality of explosive pellets having a concentration of explosive corresponding to the tabulated value adjacent to the intended pipe joint within a tubular bore;

venting a wall of the tubular bore with at least one aperture to equalize pressure within the tubular bore to pressure external to the tubular bore;

positioning the tubular bore within the pipe string proximate to the intended pipe joint;

applying a moderate torque to the pipe string; and detonating the plurality of explosive pellets simultaneously with the application of the moderate torque to disassemble the pipe string.

14. The method of claim 13, wherein the step of venting a wall of the tubular bore with at least one aperture comprises venting said wall with a plurality of apertures at approximately two-foot intervals.

15. The method of claim 14, wherein the step of detonating the plurality of explosive pellets is accomplished by a booster explosive positioned at one end of, and in detonation proximity with, the plurality of explosive pellets.

16. The method of claim 15, further comprising the step of providing a fluid barrier between the booster explosive and the plurality of explosive pellets.

17. A downhole mini-severing and back-off tool apparatus comprising:

a firing head secured to an initiation housing, wherein the firing head comprises a detonator therein;

a pellet tube secured in the initiation housing, wherein the pellet tube comprises an enclosure wall;

a plurality of explosive pellets in contiguous alignment within the enclosure wall of the pellet tube;

at least one of said plurality of explosive pellets positioned within ignition proximity of said detonator;

a bias at a first end of the plurality of explosive pellets, wherein the bias urges a second end of the plurality of explosive pellets in detonation proximity with the booster explosive; and at least one aperture in the enclosure wall of the pellet tube, wherein the at least one aperture substantially equalizes a pressure within the enclosure wall of the pellet tube with a pressure external of the enclosure wall of the pellet tube prior to detonation.

18. The apparatus as described by claim 17, wherein the bias at the first end of the plurality of explosive pellets is mechanical.

19. The apparatus as described by claim 18, wherein the mechanical bias at the first end of the plurality of explosive pellets comprises a coil spring.

20. The apparatus as described by claim 17, wherein the at least one aperture comprises a plurality of apertures distributed along a length of the enclosure wall.

21. The apparatus as described by claim 20, wherein the plurality of apertures are distributed at approximately two-foot intervals.

22. The apparatus as described by claim 17, further comprising a fluid barrier disposed between the detonator and at least one of the plurality of explosive pellets.

23. The apparatus as described by claim 17, further comprising an O-ring seal between the firing head and the initiation housing.

24. A method of releasing a threaded pipe joint within a pipe string comprising the steps of:

providing a tube having a bore space enclosed by a tube wall;

providing an initiation housing;

securing a first end of said tube to said initiation housing;

providing a firing head having an explosive detonator therein;

securing said initiation housing to said firing head;

penetrating said tube wall with at least one aperture to equalize pressure internal and external to the tube wall;

inserting a plurality of explosive pellets into the bore space;

biasing against one end of the plurality of explosive pellets to urge an opposite end of the plurality of explosive pellets into detonation proximity with said detonator;

positioning the be within a pipe string flow bore adjacent to a threaded pipe joint; and applying a torque on the pipe string and simultaneously detonating at least one of the plurality of explosive pellets for disassembling the pipe string.

25. The method of claim 24, wherein the step of penetrating said tube wall with at least one aperture comprises penetrating said tube wall with a plurality of apertures at approximately two-foot intervals.

26. The method of claim 24, wherein the step of biasing against one end of the plurality of explosive pellets is accomplished with a coil spring.

27. The method of claim 24, further comprising the step of providing a fluid barrier between the explosive detonator and the plurality of explosive pellets.

28. The method of claim 24, wherein the step of inserting a plurality of explosive pellets into the bore space comprises contiguously aligning and inserting each of the plurality of explosive pellets into the bore space.

* * * * *